US008807685B2

(12) United States Patent
Ishida

(10) Patent No.: US 8,807,685 B2
(45) Date of Patent: Aug. 19, 2014

(54) IMAGE FORMING DEVICE AND IMAGE FORMING METHOD

(71) Applicant: Riso Kagaku Corporation, Tokyo (JP)

(72) Inventor: Mari Ishida, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/028,879

(22) Filed: Sep. 17, 2013

(65) Prior Publication Data

US 2014/0085370 A1 Mar. 27, 2014

(30) Foreign Application Priority Data

Sep. 27, 2012 (JP) ..... 2012-214738

(51) Int. Cl.
*B41J 2/045* (2006.01)

(52) U.S. Cl.
CPC ..... *B41J 2/04573* (2013.01)
USPC ..... 347/14; 347/19; 347/78

(58) Field of Classification Search
CPC ..... B41J 2002/033; B41J 2/04526; B41J 2/04505; B41J 2/04508; B41J 2/04561; B41J 2/2135; B41J 29/38
USPC ..... 347/14–16, 19, 37, 41, 43, 77–82
See application file for complete search history.

(56) References Cited

U.S. PATENT DOCUMENTS 7,762,644 B2 * 7/2010 Kinoshita ..... 347/19
2013/0335470 A1 * 12/2013 Saitou ..... 347/14

FOREIGN PATENT DOCUMENTS

JP 2010-023294 2/2010
JP 2010-234681 10/2010

* cited by examiner

*Primary Examiner* — Thinh Nguyen
(74) *Attorney, Agent, or Firm* — Greenblum & Bernstein, P.L.C.

(57) ABSTRACT

An image forming device and an image forming method capable of suppressing a deviation of ink landing position generated by transfer unevenness of a transfer belt and also suppressing a deviation of ink landing position at a fine level generated by the different causes by generating correction profile data specifying a correction value of ink ejection timing from contents of the deviation of landing position of each pixel calculated by reading a test pattern image printed by an inkjet printer by a scanner unit and by performing ink ejection timing correction using the correction profile data.

4 Claims, 12 Drawing Sheets

IMAGE FORMING DEVICE AND IMAGE FORMING METHOD

BACKGROUND OF THE INVENTION

1. Field of the Invention

The present invention relates to an image forming device having a line-type inkjet head in which a line head including a plurality of nozzles configured to eject ink arranged in a main-scanning direction is arranged for each color at intervals in a sub-scanning direction perpendicular to the main-scanning direction.

2. Description of the Related Art

In the field of the inkjet image forming device, the use of the line-type inkjet printer has been spreading, which enables implementation of high-speed printing by performing image formation (printing) in the main-scanning direction by so-called one-path printing.

In the inkjet printer of this type, a line head is used in which a plurality of nozzles configured to eject ink is arranged in the main-scanning direction. In particular, in the inkjet printer capable of printing in two or more colors, line heads for respective colors are arranged at intervals in the sub-scanning direction perpendicular to the main-scanning direction.

In addition, a color image is formed on a print paper by causing each nozzle of the line head to eject ink droplets when the print paper passes under the line head of each color while transferring the print paper in the sub-scanning direction.

Incidentally, in the color inkjet printer, a deviation of landing position of ink droplets of two or more colors intended to land on the same pixel position of the print paper causes a disadvantage that the color of the pixel becomes different tinges from the original color. In addition, it is known that such a disadvantage is generated also in the case where unevenness associated with vibration in the main-scanning direction and in the sub-scanning direction is caused when the print paper is transferred by an endless transfer belt.

Accordingly, in order to prevent the change in color of an image, resulting from the deviation of landing position of ink droplets of each color generated by the transfer unevenness of the print paper by the transfer belt, it is proposed that profile data with contents corresponding to the transfer unevenness of the transfer belt is acquired or selected from alternatives and the ink ejection timing is corrected using this (for example, Patent Documents 1 and 2).

[Patent Document 1] Japanese Patent Application Laid-Open Publication No. 2010-234681

[Patent Document 2] Japanese Patent Application Laid-Open Publication No. 2010-23294

SUMMARY OF THE INVENTION

Incidentally, the deviation of ink landing position is generated by causes other than the transfer unevenness of the transfer belt described above, and there is a case where the level of the deviation of position differs depending on the factors that cause the deviation. For example, it is said that the level of the deviation of ink landing position generated by the transfer unevenness of the transfer belt is comparatively large (for example, the position deviation of 40 μm or more). However, there is a deviation of position, which occurs at a comparatively fine level (for example, the position deviation of about 5 to 10 μm).

In addition, according to the conventionally required printing quality, the dot on the print paper has a diameter of moderate size, and thus a large change in color of an image does not occur as long as the portions overlapping one another can be ensured to a certain extent even if there is a small degree of landing position deviation of ink of two or more colors. Consequently, it is possible to sufficiently prevent a change in color of an image from occurring even by the ink ejection timing correction using the profile data having contents corresponding to the transfer unevenness of the transfer belt.

However, in recent years, along with the demand for improving image quality, the reduction in size of the ink droplet, and thereby, a reduction in diameter of the dot have been required. When the dot diameter is reduced, dots do not overlap one another even if there is a slight deviation of landing position of ink of each color, and the change in color of an image becomes more conspicuous. That is, compared with the case where the dot diameter is large, the degree of the change in color of an image caused by the deviation of ink landing position becomes large.

Consequently, when the ink ejection timing correction is performed using the conventional profile data with contents corresponding to the transfer unevenness of the transfer belt, it is no longer possible to sufficiently prevent the change in color of an image when an image of high quality is printed, and there is a case where the change in color appears in the image.

Furthermore, the deviation of ink landing position caused by the transfer unevenness of the transfer belt is repeated with a period during which the transfer belt makes one rotation, but the deviation of ink landing position caused by other causes is not necessarily repeated with the same period.

In addition, the above-described problem occurs similarly not only in the case where the dot diameter is reduced associated with the reduction in size of the ink droplet but also, for example, in the case where the dot diameter is reduced associated with the change in dot gain, such as in the case where the type of print paper is changed from ordinary paper to matte paper. Furthermore, the problem also occurs in the case or the like where there is a change in ink characteristics when the material is changed.

The present invention has been made in view of the above-mentioned circumstances and an object of the present invention is to provide an image forming device capable of suppressing a deviation of ink landing position caused by transfer unevenness of a transfer belt and also of suppressing a deviation of ink landing positions generated by the different causes.

In order to achieve the above-mentioned object, the present invention is an image forming device (for example, line-type inkjet printer 1 in FIG. 1) for forming a color image on a print paper by arranging a line head (for example, line head 110 in FIG. 3A), in which a plurality of nozzles is provided so as to extend along a main-scanning direction (for example, main-scanning direction Xd in FIG. 3A), for each color at intervals in a sub-scanning direction (for example, sub-scanning direction Yd in FIG. 3A) perpendicular to the main-scanning direction, and causing ink droplets from the corresponding nozzle of the line head of each color to land on the same pixel of the print paper (for example, print paper S in FIG. 1) transferred by a transfer belt (for example, transfer belt 160 in FIG. 1) in the sub-scanning direction, and the image forming device includes:

a landing-position-deviation-pattern acquisition unit (for example, control unit 10 in FIG. 8) configured to acquire a landing position deviation pattern of ink droplets of each color corresponding to at least one period (for example, "one period of landing position deviation pattern" in FIG. 7) from a test pattern image in a plurality of chromatic colors formed on the print paper by the ink droplets from the line head;

a storage unit (for example, external storage device 93 in FIG. 8) configured to storing, as correction profile data which is associated with an amount of rotation of the transfer belt corresponding to the one period, a correction pattern of an ejection timing of ink of each color, for setting, to a certain level, the relative deviation of landing position of ink droplets of each color obtained from the landing position deviation pattern of ink droplets of each color for the one period, during the rotation of the transfer belt corresponding to the one period; and a corrector (for example, control unit 10 in FIG. 8) configured to determine the amount of correction of the ejection timing of ink droplets by each nozzle of the line head of each color on the basis of the correction profile data stored in the storage unit for each color and the amount of rotation of the transfer belt and configured to correct the ejection timing of ink droplets by each nozzle of the line head of each color with the determined amount of correction.

According to the above-described invention, the test pattern image includes the landing position deviation component by the transfer unevenness of the transfer belt and the ink landing position deviation component resulting from factors other than the transfer unevenness of the transfer belt. Consequently, by correcting the ejection timing of ink droplets on the basis of the correction profile data including the landing position deviation pattern corresponding to one period acquired by the landing-position-deviation-pattern acquisition unit, it is possible to suppress the deviation of ink landing position caused by the transfer unevenness of the transfer belt and also suppress the deviation of ink landing position at a fine level generated by the different causes.

In addition, in the present invention, the landing-position-deviation-pattern acquisition unit identifies the one period by performing Fourier transform on the composite fluctuation amount of each amount of the deviation of landing position of ink droplets of other colors (for example, magenta (M), yellow (Y) in FIG. 10A) with respect to the ink droplets of the reference color (for example, cyan (C) in FIG. 10A) in the test pattern image, and acquires the landing position deviation pattern of each ink droplet between the reference color and the other colors corresponding to the identified one period.

According to the above-mentioned invention, it is possible to easily identify one period of the landing position deviation pattern of ink droplets of each color different from the rotation period of the transfer belt from each amount of the deviation of landing position of ink droplets of other colors with respect to the ink droplets of the reference color in the test pattern image by Fourier transform, and to reliably cause the landing-position-deviation-pattern acquisition unit to acquire the landing position deviation pattern corresponding to one period.

Furthermore, in the present invention, the correction pattern of the correction profile data defines the amount of adjustment of the relative landing position of ink droplets from the line head at the downstream side with respect to the landing position of ink droplets from the line head at the upstream side, in the transfer direction of the print paper by the transfer belt.

According to the above-mentioned invention, it is possible to easily determine the amount of correction of the ejection timing of each color by bringing the landing position of the ink droplet of another color that lands on the print paper later, close to the landing position of the ink droplet of the color that lands on the print paper earlier.

Meanwhile, the present invention further includes a size detector (for example, control unit 10 in FIG. 8) configured to detect the paper size of the print paper transferred by the transfer belt, and it may also be possible for the corrector to determine the amount of correction of the ejection timing of ink droplets by each nozzle of the line head of each color further on the basis of the paper size detected by the size detector.

According to the above-described invention, the position of the portion of the print paper located on the transfer belt is changed depending on the paper size. Therefore, by determining the amount of correction of the ejection timing of ink droplets on the basis of the paper size, it is possible to suppress the deviation of ink landing position generated by the transfer unevenness of the transfer belt even if the size of the print paper changes.

In addition, the present invention includes a paper type setting unit (for example, control unit 10 in FIG. 8) configured to set the paper type of the print paper transferred by the transfer belt, and it may also be possible for the corrector to determine the amount of correction of the ejection timing of ink droplets by each nozzle of the line head of each color on the basis of the paper type set by the paper type setting unit.

According to the above-mentioned invention, the extent of permeation of the ink droplets is different and the dot gain changes, depending on the paper type, and thus there arises a difference in the amount of change in color resulting from the deviation of landing position. Consequently, by determining the amount of correction of the ejection timing of ink droplets on the basis of the paper type, it is possible to suppress the deviation of ink landing position even if the paper type changes.

DESCRIPTION OF THE PREFERRED EMBODIMENTS

Hereinafter, an embodiment of the present invention will be described with reference to the drawings. In all the drawings, the same or equivalent sign is attached to the same or equivalent portion and components and explanations thereof is omitted or simplified.

Figure 1:
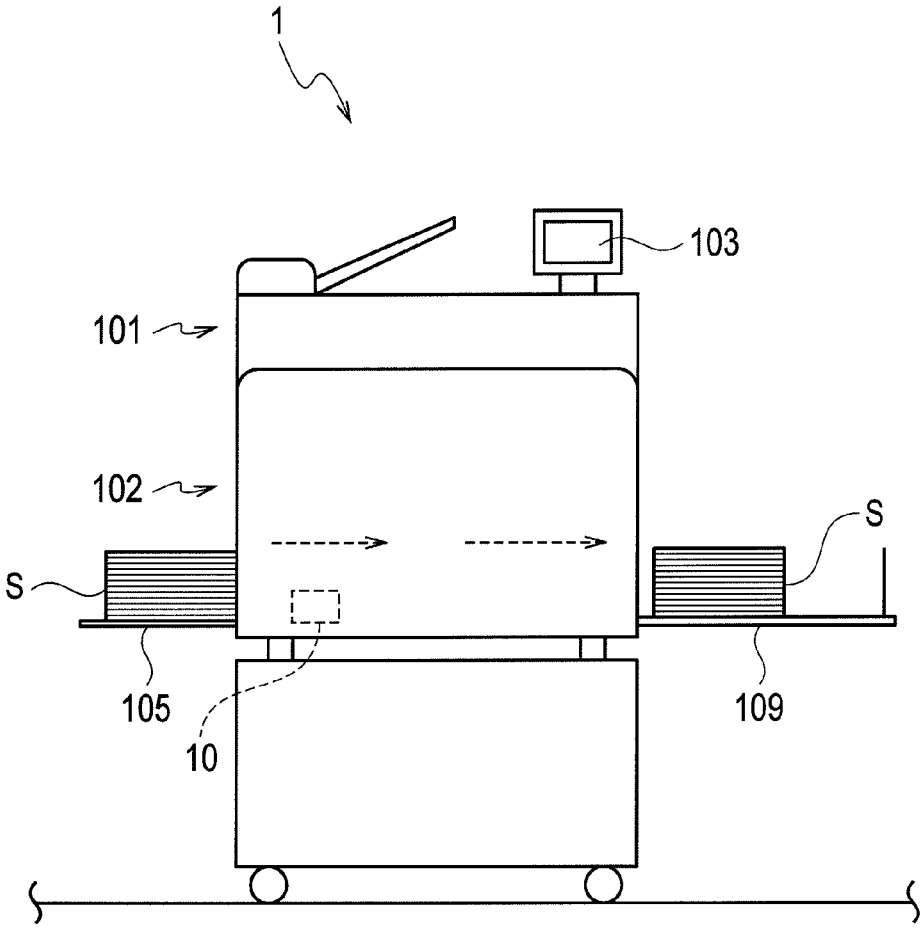
FIG. 1 is an explanatory diagram schematically showing a configuration of a line-type inkjet printer to which the present invention is used.

FIG. 1 is an explanatory diagram schematically showing a configuration of a line-type inkjet printer to which the present invention is used. As shown in FIG. 1, a line-type inkjet printer (hereinafter, abbreviated to "inkjet printer", corresponding to the image forming device in claims) 1 of the present embodiment is provided with a scanner unit 101 configured to read an original image on an original and output an image signal, a printer unit 102 configured to print (record) the original image on print paper S (one side or both sides) on the basis of the image signal output from the scanner unit 101, a display 103 for inputting and outputting various kinds of information, and a control unit 10 for total control. The print paper S used for printing of the original image in the printer unit 102 is transferred from a paper feeder 105 to a paper discharger 109 via the printer unit 102.

Figure 2:
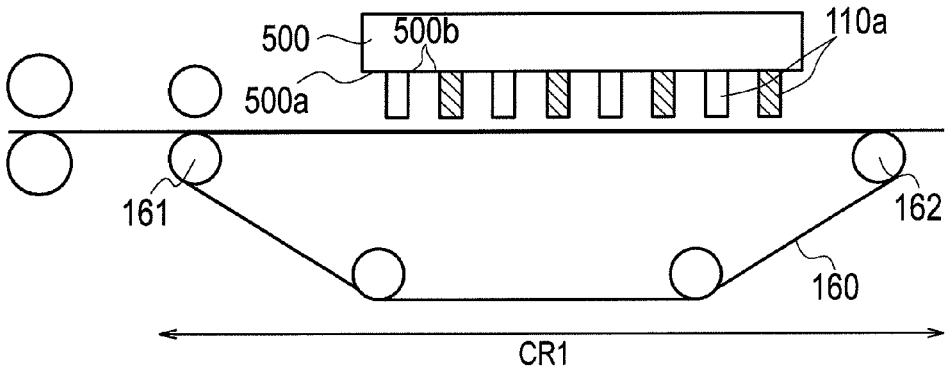
FIG. 2 is an explanatory diagram showing, from the side, an image forming path of a printer unit shown in FIG. 1.
Figure 3A:
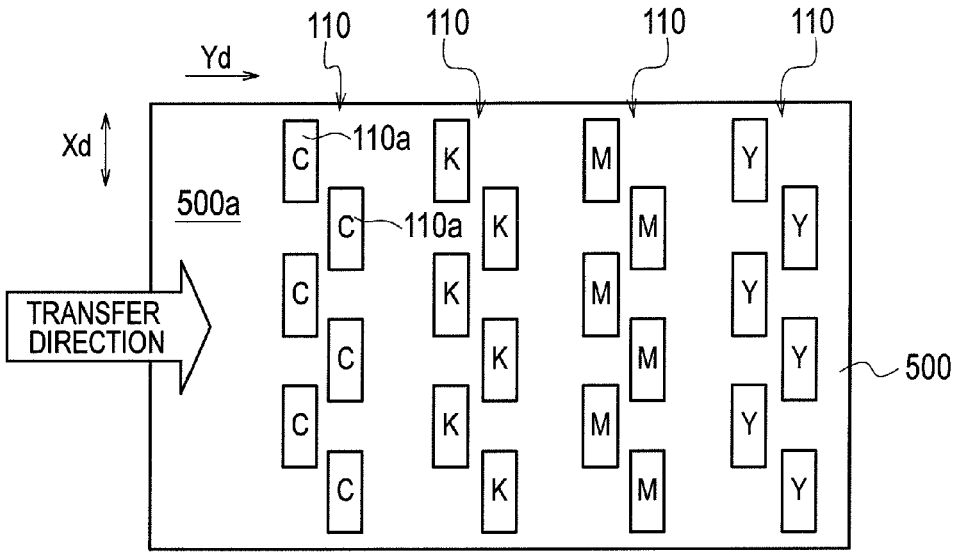
FIG. 3A is an explanatory diagram schematically showing a head holder in FIG. 2 when viewed from below.
Figure 3B:
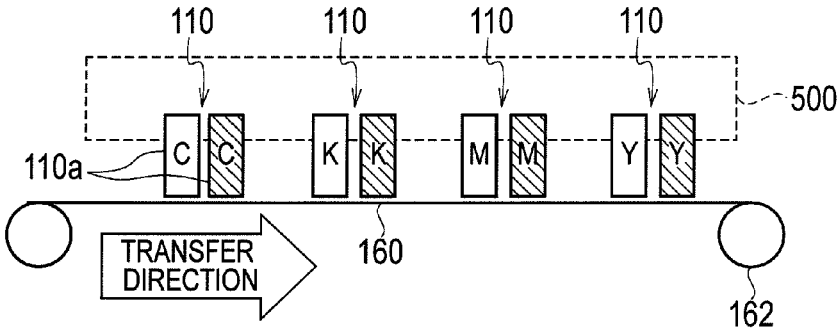
FIG. 3B is an explanatory diagram schematically showing a side cross-section of the head holder in FIG. 2.

FIG. 2 is an explanatory diagram showing, from the side, an image forming path CR1 in which an image is formed in the printer unit 102 of the inkjet printer 1 according to the present embodiment, FIG. 3A is an explanatory diagram showing, from below, a head holder 500 in FIG. 2, which is arranged above the image forming path CR1, and FIG. 3B is an explanatory diagram showing an enlarged side cross-section of the head holder 500.

The printer unit 102 of the inkjet printer 1 according to the present embodiment has a line head 110, which is an image forming unit, for each color. As shown in FIG. 3A, the line head 110 of each color extends along a main-scanning direction Xd and the line head 110 of each color is arranged at regular intervals in a sub-scanning direction Yd. Furthermore, the line head 110 of each color includes a plurality of head blocks 110*a* arranged side by side in the main-scanning direction Xd.

As shown in FIG. 2, a printing device according to the present embodiment includes the image forming path CR1 as its transfer path and in this image forming path CR1, the print paper S (see FIG. 1) is transferred by the transfer belt 160 in the sub-scanning direction Yd at a speed determined by printing conditions. Above the image forming path CR1, the line head 110 of each color is arranged facing a transfer belt 160 and from a nozzle of each head block 110*a* included in the line head 110, ink of each color is ejected in units of lines to the print paper S on the transfer belt 160 and a plurality of images is formed so that they overlap with one another.

In detail, the image forming path CR1 includes the transfer belt 160, which is an endless transfer belt, a drive roller 161, which is a drive mechanism of the transfer belt 160, a driven roller 162 and the like. Above the image forming path CR1, the head holder 500 is provided and the head block 110*a* of the line head 110 of each color is held in the head holder 500.

The transfer belt 160 is caused to rotate and move by the drive roller 161, and slides in the range in which the transfer belt 160 faces the head block 110*a* to thereby transfer the print paper S. Specifically, the transfer belt 160 is hooked between a pair of the drive rollers 161 and a pair of the driven rollers 162 extending in the main-scanning direction, respectively, and is caused to rotate in the sub-scanning direction Yd by the driving force of the drive roller 161.

The head holder 500 is a box having a head holder surface 500*a* on its bottom, and stores other function portions, being formed into units, for causing the head block 110*a* to eject ink as well as holding and fixing the head block 110*a* of the line head 110 of each color. The head holder surface 500*a*, which is the bottom of the head holder 500, is arranged in opposition to the transfer path so as to be parallel thereto. On the head holder surface 500*a*, a plurality of attachment openings 500*b* is arranged. Each attachment opening 500*b* is formed into the same shape as that of the horizontal cross-section of the head block 110*a*. The plurality of the head blocks 110*a* is inserted into the respective attachment openings 500*b*, causing their ejection outlets to protrude from the head holder surface 500*a*.

As shown in FIG. 3A and FIG. 3B, the head block 110*a* is provided in a plural number for each color of C (cyan), K (black), M (magenta), and Y (yellow). The head block 110*a* of each color is arranged at intervals in the sub-scanning direction Yd. The plurality of the head blocks 110*a* of each color is arranged side by side in the main-scanning direction Xd and also arranged being shifted alternately in the transfer direction. Due to this, the interval between the nozzles (not shown) at the tip end parts of the two neighboring head blocks 110*a* agree with the interval between the neighboring nozzles of each head block 110*a*.

It is possible to change the number of ink drops ejected from each head block 110*a*. The number of ejected drops (number of droplets) changes the density of the dot. Note that the inkjet printer 1 of the present embodiment has a function to adjust the size of the drop as the amount of the droplet. The adjustment of the amount of the droplet in the head block 110*a* can be performed by adjusting the drive voltage of the head block 110*a*.

Incidentally, there is a case where unevenness associated with vibration in the main-scanning direction Xd and in the sub-scanning direction Yd when transferring the print paper S is generated in the transfer belt 160 because of the unevenness of its thickness, eccentricity of the drive roller 161 and the driven roller 162, wear and the like. When transfer unevenness of the print paper S is generated, a deviation of landing position of ink droplets of two or more colors intended to land on the same pixel position of the print paper S occurs, and thus the color of the pixel may change to different tinges from the original color.

Figure 4:
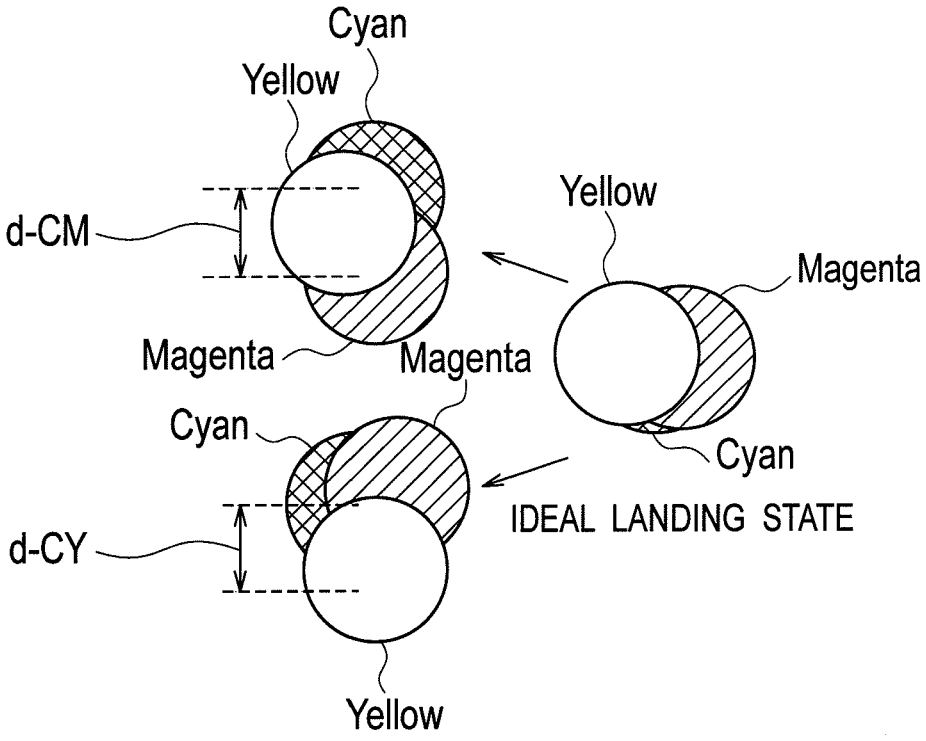
FIG. 4 is an explanatory diagram showing changes in color caused by the deviation of landing position of ink droplets of three colors of cyan (C), magenta (M), and yellow (Y).

In the explanatory diagram in FIG. 4, the diagram on the right side shows an ideal landing state of the pixel on which the ink droplets of three colors of cyan (C), magenta (M), and yellow (Y) land.

For example, as shown in the diagram on the top left side in FIG. 4, there is supposed a case where magenta (M) has landed on a position deviated in the sub-scanning direction Yd from the ideal landing state of the pixel on which the ink droplets of three colors of cyan (C), magenta (M), and yellow (Y) are intended to land. In the following, an amount of the deviation of landing position in the sub-scanning direction Yd of magenta (M) with respect to cyan (C) is expressed as d_CM. In this case, as d_CM increases, the area of the dot of magenta (M) that does not overlap with the dots of cyan (C) and yellow (Y) but bulges out toward outside increases, and thus the color of the pixel changes to a reddish tinge.

Next, as shown in the diagram on the bottom left side in FIG. 4, there is supposed a case where yellow (Y) has landed on a position deviated in the sub-scanning direction Yd from the ideal landing state of the pixel on which the ink droplets of three colors of cyan (C), magenta (M), and yellow (Y) are intended to land. In the following, an amount of the deviation of landing position in the sub-scanning direction Yd of yellow (Y) with respect to cyan (C) is expressed as d_CY. In this case, as d_CY increases, the area of the dot of yellow (Y) that does not overlap with the dots of cyan (C) and magenta (M) but bulges out toward outside increases, and thus the color of the pixel changes to a yellowish tinge.

As described above, when a relative deviation of landing position between the ink of the three colors of cyan (C), magenta (M), and yellow (Y) is generated, the color of the image changes from its original color. Then, the change in color of the image due to such a deviation of landing position appears more remarkably as the dot diameter becomes smaller in such a case as shown below.

Figure 5A:
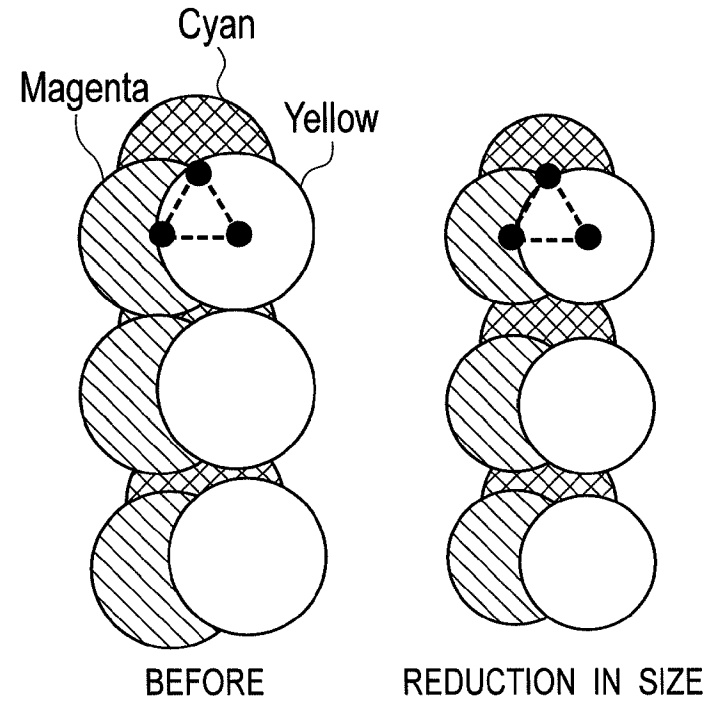
FIG. 5A is an explanatory diagram showing changes in color caused by the difference in the dot diameter of ink droplets of three colors of cyan (C), magenta (M), and yellow (Y).

Furthermore, by a reduction in size of the ink droplet demanded by improvement in image quality, even in the case of the same number of drops, when the dot diameter of the ink that lands on the print paper S is reduced, the dot diameter is reduced to, for example, approximately 0.8 with respect to the conventional dot diameter of 1 as shown in FIG. 5A by comparison. In this case, in an image whose dot diameter is reduced compared with the conventional image, even if the amount of the deviation of ink landing position or the direction shown by black circles in the diagram does not change, the ratio of the area of the portion that does not overlap with the dots of other colors increases in the image whose dot diameter is reduced, and thus the color becomes susceptible to change. That is, as the dot diameter becomes smaller, the color of an image changes even if the landing position is the same.

Figure 5B:
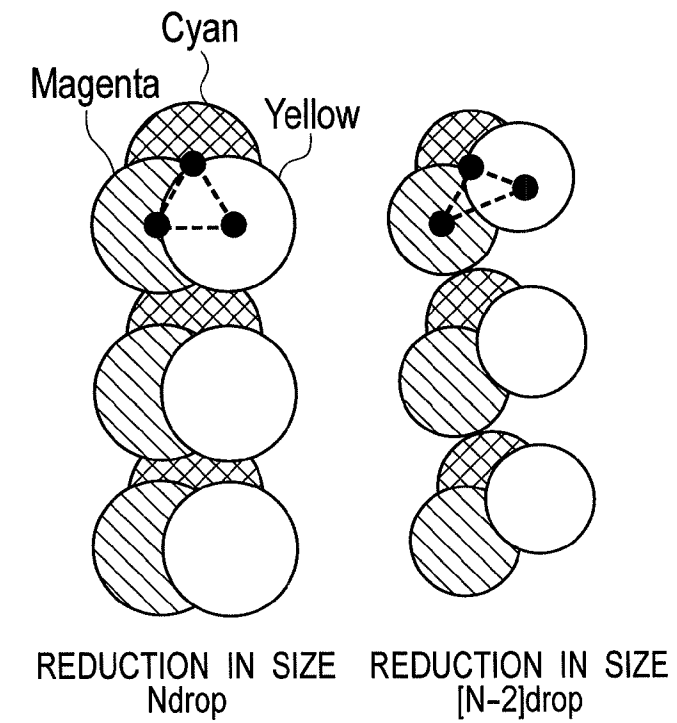
FIG. 5B is an explanatory diagram showing changes in color caused by the difference in the number of ink droplets of three colors of cyan (C), magenta (M), and yellow (Y).

Moreover, in the image whose dot diameter is reduced, as shown in FIG. 5B by comparison, when the number of drops is reduced from N drops (dot diameter 0.8) to N-2 drops (dot diameter 0.64), the relative landing position itself of the ink droplet of each color changes and the contents of the deviation of landing position change. In the example shown in FIG. 5B, by the change in landing position due to the reduction in the number of drops, the area of the dots of magenta (M) and yellow (Y) that overlap each other is reduced and the color changes. That is, when the number of drops is reduced, the landing position also changes, and thus the color of the image changes.

Figure 6A:
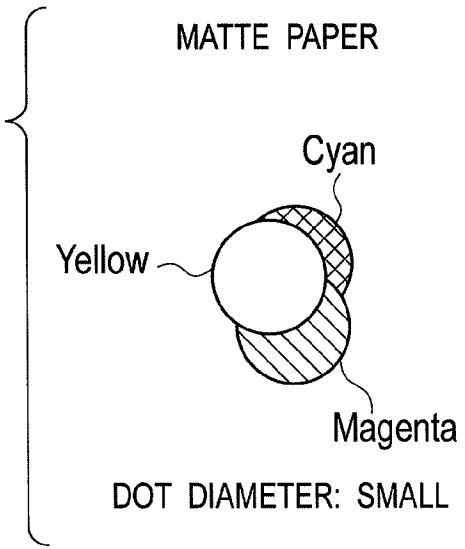
FIG. 6A is an explanatory diagram showing the dot diameter and the deviation of landing position on matte paper.
Figure 6B:
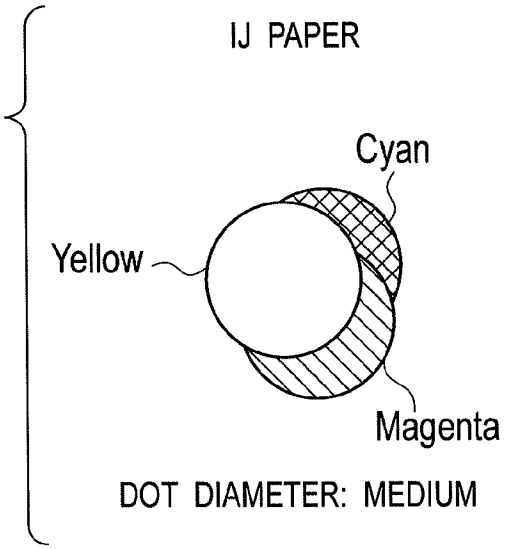
FIG. 6B is an explanatory diagram showing the dot diameter and the deviation of landing position on IJ (inkjet) paper.
Figure 6C:
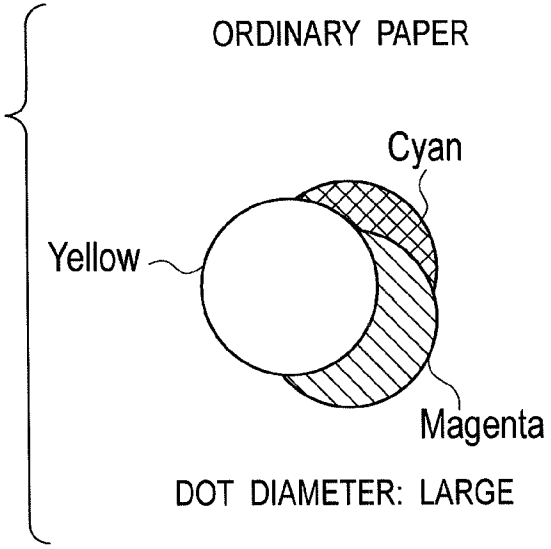
FIG. 6C is an explanatory diagram showing the dot diameter and the deviation of landing position on ordinary paper.

FIG. 6A, FIG. 6B, and FIG. 6C are explanatory diagrams showing the dot diameter and the deviation of landing position in accordance with the type of print paper. The comparison between FIG. 6A, FIG. 6B, and FIG. 6C indicates the difference in the dot diameter and the change in color resulting therefrom, which are caused by the difference in the dot gain in accordance with the type of print paper.

FIG. 6A shows a case where printing is performed on matte paper and the maximum amount of ink to be ejected is set to six drops. In addition, FIG. 6B and FIG. 6C show cases where printing is performed on inkjet (IJ) paper and on ordinary paper, respectively, and the maximum amount of ink to be ejected is set to five drops. The permeability to the paper becomes lower in order from the ordinary paper, the IJ (inkjet) paper and the matte paper, and ink is most unlikely to be permeated into the matte paper.

Compared with the dot diameter of the print paper S of the type, into which ink is easily permeated, such as the IJ (inkjet) paper in FIG. 6B and the ordinary paper in FIG. 6C, the dot diameter of the matte paper in FIG. 6A, into which ink is unlikely to be permeated is small. Furthermore, the maximum number of drops of the matte paper is set somewhat larger than that of the IJ paper and the ordinary paper by an amount corresponding to the difference in the dot diameter. Consequently, the change in color due to the deviation of landing position appears more remarkably in the matte paper than in the IJ paper and the ordinary paper.

The deviation of landing position of the matte paper is easily conspicuous, and thus the landing position needs to be corrected. In contrast, the deviation of landing position of the IJ (inkjet) paper and the ordinary paper is not easy to be conspicuous, and thus the necessity of correcting the landing position is not great compared with the case of the matte sheet.

The reduction in the dot diameter illustrated as above occurs independently of the transfer unevenness of the transfer belt 160. Consequently, it is obvious that the change in color due to the reduction in the dot diameter does not synchronize with at least the period of the transfer unevenness of the transfer belt 160.

Figure 7:
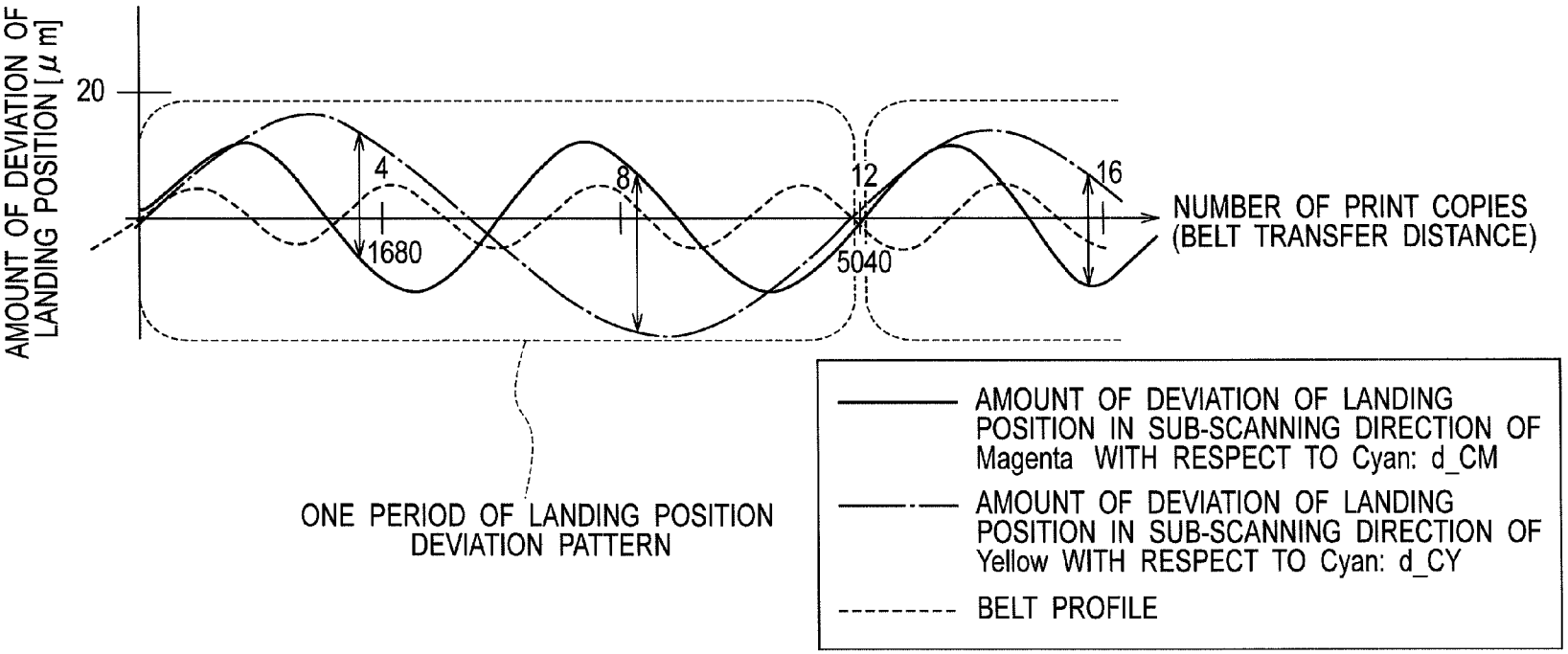
FIG. 7 is an explanatory diagram showing examples of changes in the amount of the deviation of landing position of ink of magenta (M) with respect to cyan (C) and the amount of the deviation of landing position of ink of yellow (Y) with respect to cyan (C) in accordance with the transfer distance of the print paper by the transfer belt.

Therefore, the inventors of the present invention actually measured the change in the amount d_CM of the deviation of ink landing position of magenta (M) with respect to cyan (C) and the change in the amount d_CY of the deviation of ink landing position of yellow (Y) with respect to cyan (C), in accordance with the transfer distance of the print paper S by the transfer belt 160. As a result, as shown in FIG. 7, it has been found that both the amounts change in the form of a sinusoidal wave, but the periods and the amplitudes of both do not agree with each other and both the amounts change with a period longer than the period of the transfer unevenness of the transfer belt 160 (period of the belt profile). From the measurement result shown in FIG. 7, it has been found that the transfer distance of 12 pieces of print paper S of A3 size (in the longitudinal direction) corresponds to one period of the change in the deviation of landing position.

As described above, the change in color of an image associated with the deviation of landing position that appears remarkably due to the reduction of the dot size is a very small deviation (for example, deviation of about 5 to 10 μm) compared with the deviation of landing position generated by the transfer unevenness of the transfer belt 160 (for example, deviation of 40 μm or more), and further, the change occurs with a period that does not synchronize with that of the transfer unevenness of the transfer belt 160.

Therefore, by the ink ejection timing correction using the belt profile data for eliminating the deviation of landing position caused by the transfer unevenness of the transfer belt 160, which has been performed so far, it is not possible to eliminate the deviation of landing position that appears remarkably due to the reduction of the dot diameter.

As explained above, when the dot diameter is reduced, the change in color of an image due to the deviation of landing position becomes more remarkably conspicuous than before, and in the case where the number of drops is small, the change becomes further prominently conspicuous, resulting in degradation of image quality.

Therefore, in the inkjet printer 1 of the present embodiment, in order to suppress not only the deviation of ink droplet landing position caused by the transfer unevenness of the transfer belt 160 but also the deviation caused by other factors, it is made possible for the control unit 10 to adjust the ejection timing of ink droplets ejected from the nozzle, for each nozzle in the head block 110*a* of the line head 110 of each color, by using profile data other than the belt profile data.

Figure 8:
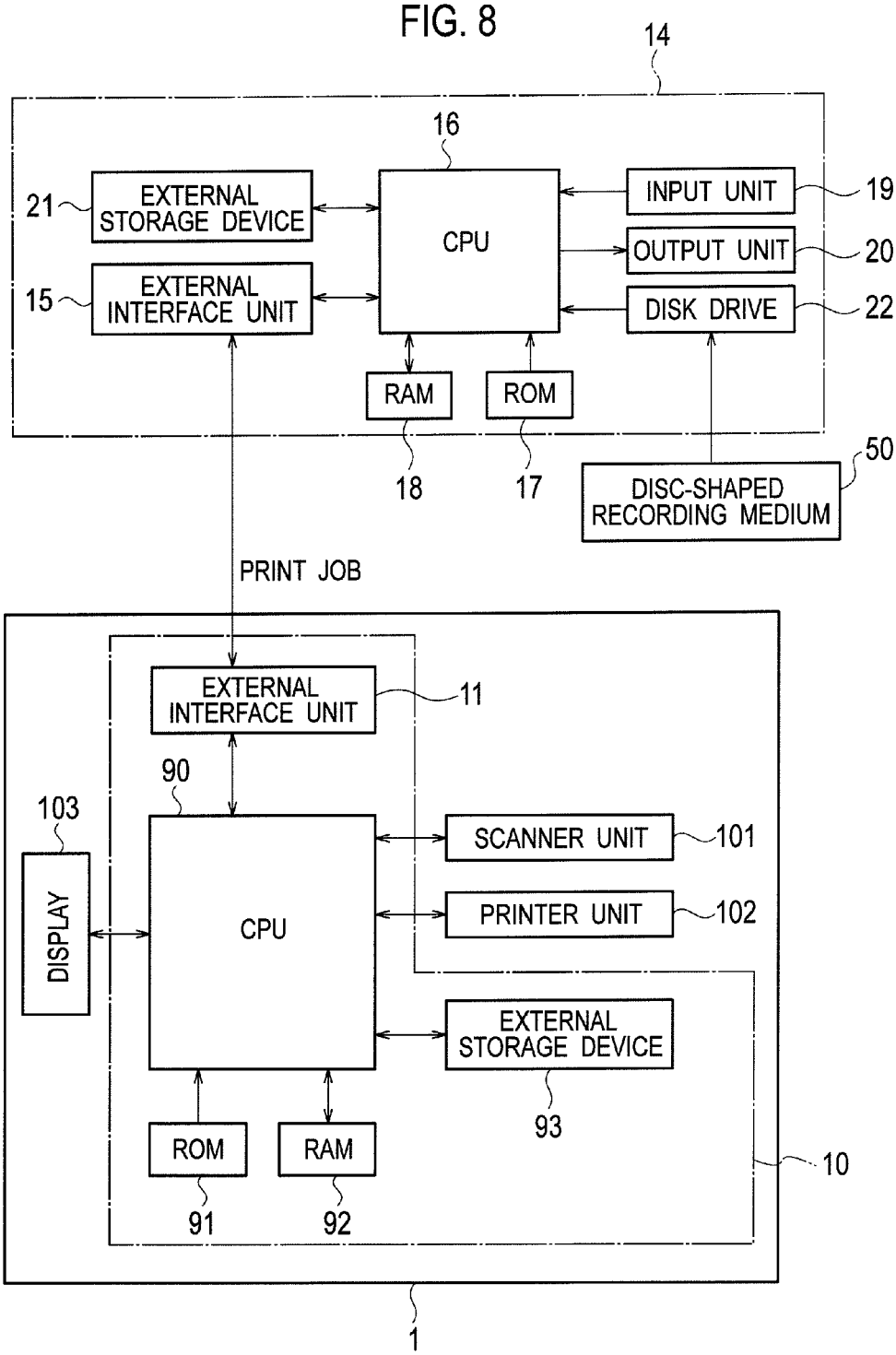
FIG. 8 is a block diagram showing a configuration of a control system of the line-type inkjet printer in FIG. 1.

FIG. 8 is a block diagram showing an electrical configuration of the control unit 10 in FIG. 1. As shown in FIG. 8, to the control unit 10, an external interface unit 15 of a client terminal 14, to be described later, is connected via an external interface unit 11. For this connection, for example, a wired LAN of 100BASE-TX is used. The control unit 10 receives a print job of an original image from the client terminal 14. The print job includes postscript data and printing environment data. The control unit 10 generates raster data of the original image by the postscript data of the received print job. The inkjet printer 1 executes printing of the original image onto the print paper S under the conditions specified by the printing environment information of the print job at the printer unit 102.

Furthermore, to a CPU 90 of the control unit 10, the display 103 is connected. As shown in FIG. 1, the display 103 is arranged at the upper part of the inkjet printer 1. In the case where the inkjet printer 1 is used in the scanner mode to read an image from the print paper S by the scanner unit 101, it is possible to utilize the display 103 as an input operation unit through which a user selects and inputs a menu, such as conversion of the read image into electronic data and self-diagnosis.

As shown in FIG. 8, the control unit 10 of the inkjet printer 1 that causes the printer unit 102 to perform the printing operation includes the CPU 90. The CPU 90 controls the operation of the scanner unit 101 and the printer unit 102 in accordance with the contents input and set from the display 103 on the basis of programs and setting information stored in a ROM 91.

Note that the control unit 10 is provided with a RAM 92 and in the RAM 92, the contents or the like of the selected menu input from the display 103 are stored at anytime. In addition, the RAM 92 is provided with a frame memory region. In the frame memory region, the raster data of the original image, which is generated by the CPU 90 from the postscript data of the print job input to the control unit 10 from the client terminal 14, is stored temporarily until the raster data is output to the printer unit 102.

Furthermore, the control unit 10 is provided with an external storage device 93. In the external storage device 93, firmware of the display 103, the printer engine of the printer unit 102, and the scanner unit 101 is stored in each divided region to be used.

Moreover, in the external storage device 93 (corresponding to the storage unit in claims), correction profile data is stored.

The correction profile data is data, for correcting the ejection timing of ink droplets ejected from the nozzle, which is generated in order to suppress the deviation of ink droplet landing position caused not only by the transfer unevenness of the transfer belt 160 but also by other factors. Here, the correction profile data stored in the external storage device 93 will be explained.

In the case where the amount d_CM of the deviation of landing position of ink of magenta (M) with respect to cyan (C) and the amount d_CY of the deviation of landing position of ink of yellow (Y) with respect to cyan (C) fluctuate as shown by the solid line and the alternate long and short dash line in FIG. 7, respectively, the difference between both the amounts of the deviation of landing position (difference between d_CM and d_CY) represents the fluctuation period (corresponding to one period in which the landing position deviation pattern with the same contents as those in claims is repeated) of the landing position deviation pattern of ink of each color. It is possible to obtain the frequency of the fluctuation period by performing Fourier transform on the difference between both the amounts in the deviation of landing position (difference between d_CM and d_CY).

According to the frequency obtained in such a manner, in the example shown in FIG. 7, the difference between the amount d_CM of the deviation of landing position in the sub-scanning direction Yd of ink of magenta (M) with respect to ink of cyan (C) and the amount d_CY of the deviation of landing position in the sub-scanning direction Yd of ink of yellow (Y) with respect to ink of cyan (C) (difference between d_CM and d_CY) changes repeatedly with the period corresponding to the transfer distance (one period) of 12 sheets of print paper S of A3 size (in the portrait direction). That is, the landing position deviation pattern of ink of each color fluctuates with a period longer than the rotation period of the transfer belt 160 shown by the broken line in FIG. 7.

The fact that the fluctuation period of the landing position deviation pattern of ink of each color does not coincide with the rotation period of the transfer belt 160 means that factors other than the transfer unevenness of the transfer belt 160 affect the deviation of landing position of ink of each color.

Figure 9A:
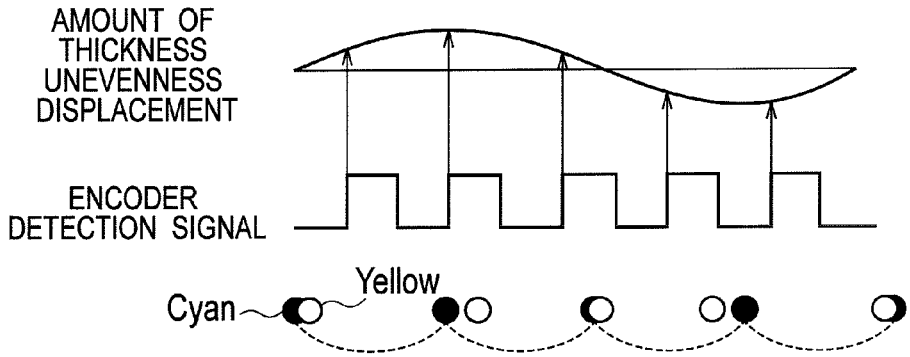
FIG. 9A is a diagram showing an encoder detection signal and the deviation of ink landing position before the ink ejection timing is corrected by belt profile data.
Figure 9B:
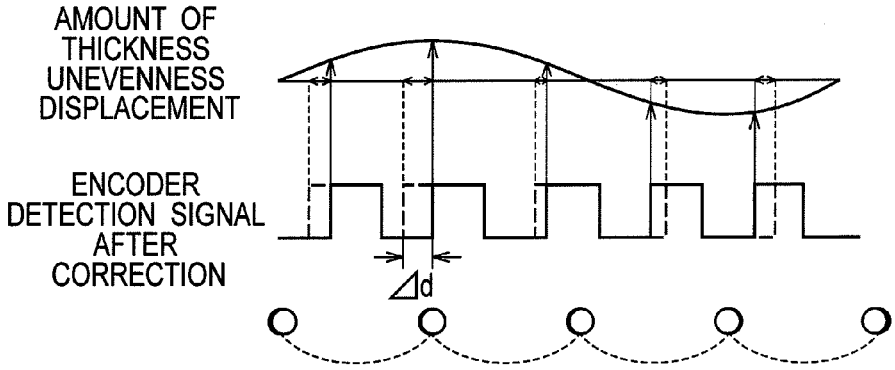
FIG. 9B is a diagram showing an encoder detection signal and the deviation of ink landing position after the ink ejection timing is corrected by belt profile data.

For the correction of the deviation of ink landing position generated by the transfer unevenness of the transfer belt 160 that occurs repeatedly in each rotation period of the transfer belt 160, the belt profile data is used. In order to correct the fluctuations in speed by the belt thickness unevenness component of the transfer belt 160, in the belt profile data, as correction values, the amounts of thickness unevenness displacement are, respectively, defined for advancing or delaying an encoder detection signal synchronized with the fluctuations in the rotation speed of the transfer belt 160 in accordance with the transfer distance from the home position of the transfer belt 160 as shown in FIG. 9A and FIG. 9B. For example, in accordance with a transfer distance X mm from the home position of the transfer belt 160, times of the amount of shift of the encoder detection signal are defined, with signs being reversed in the case of being advanced and in the case of being delayed.

By controlling the ink ejection timing with the timing in accordance with the encoder detection signal corrected by the correction value, it is possible to correct the deviation of ink landing position generated by the transfer unevenness of the transfer belt 160. Meanwhile, FIG. 9B shows the case where the deviation of landing position of ink of yellow (Y) with respect to ink of cyan (C) is corrected by the belt profile data.

However, the landing position deviation pattern of ink of each color that fluctuates with a long period that does not coincide with the rotation period of the transfer belt 160 cannot be corrected appropriately by the belt profile data in which the above-described correction values as in FIG. 9B are defined.

Consequently, in the present embodiment, the correction contents of the ejection timing of ink of magenta (M) and yellow (Y) are defined respectively in the correction profile data and stored in the external storage device 93 for each transfer distance in the period of the transfer distance (one period) corresponding to 12 sheets of print paper S of A3 size (in the portrait direction) for setting, to a certain level at all times, the difference between the amount d_CM of the deviation of landing position in the sub-scanning direction Yd of ink of magenta (M) with respect to cyan (C) and the amount d_CY of the deviation of landing position in the sub-scanning direction Yd of ink of yellow (Y) with respect to cyan (C) (the difference between d_CM and d_CY). By the correction contents of the correction profile data, it is possible to correct the deviation of ink landing position generated by various factors including the component of the deviation of landing position of ink of each color generated by the transfer unevenness of the transfer belt 160.

Figure 10A:
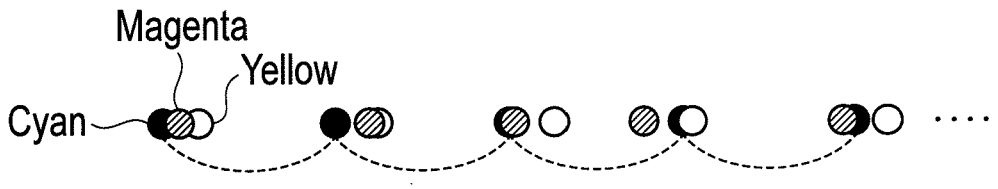
FIG. 10A is an explanatory diagram schematically showing the landing positions before the amount of the deviation of landing position that changes as in the example in FIG. 7 is corrected by the ejection timing.

For example, there is supposed a case where when the amount of the deviation of landing position changes in the period as in the example shown in FIG. 7, the amount d_CM of the deviation of landing position in the sub-scanning direction Yd of ink of magenta (M) with respect to cyan (C) and the amount d_CY of the deviation of landing position in the sub-scanning direction Yd of ink of yellow (Y) with respect to cyan (C) change as shown schematically, at each transfer distance shown in FIG. 10A in that period.

Figure 10B:
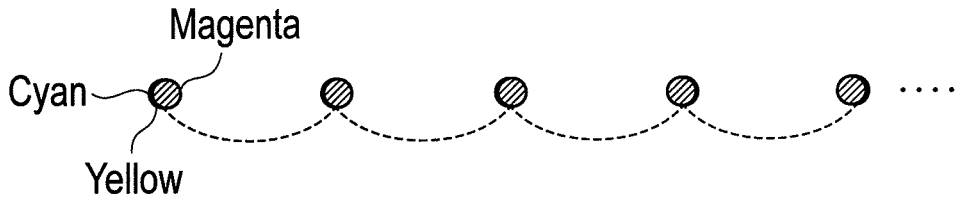
FIG. 10B is an explanatory diagram schematically showing the landing positions after the amount of the deviation of landing position that changes as in the example in FIG. 7 is corrected by the ejection timing.

In this case, the ejection timing of ink of magenta (M) with respect to the ejection timing of ink of cyan (C) and the ejection timing of ink of yellow (Y) with respect to the ejection timing of ink of cyan (C) are corrected, respectively, by the correction contents defined in the correction profile data in the external storage device 93, in accordance with the transfer distance of the print paper S. Consequently, it is possible to set, to a certain level at all times, the amount d_CM of the deviation of landing position in the sub-scanning direction Yd of ink of magenta (M) with respect to cyan (C) and the amount d_CY of the deviation of landing position in the sub-scanning direction Yd of ink of yellow (Y) with respect to cyan (C), regardless of the transfer distance of the print paper S as shown in FIG. 10B.

Here, the ejection timing of ink of each color is defined by a pulse signal indicative of the ejection period of time of the ink by the nozzle. Therefore, the shift direction, the shift amount, the amount of an increase or decrease in the pulse width and the like of the ejection timing of ink of magenta (M) with respect to the ejection timing of ink of cyan (C) are defined as correction contents in the correction profile data, for each transfer distance of the print paper S on the basis of the amount d_CM of the deviation of landing position in the sub-scanning direction Yd of ink of magenta (M) with respect to cyan (C). In the same way, the shift direction, the shift amount, the amount of an increase or a decrease in the pulse width and the like of the ejection timing of ink of yellow (Y) with respect to the ejection timing of ink of cyan (C) are defined as correction contents in the correction profile data, for each transfer distance of the print paper S on the basis of the amount d_CY of the deviation of landing position in the sub-scanning direction Yd of ink of yellow (Y) with respect to cyan (C).

Figure 11:
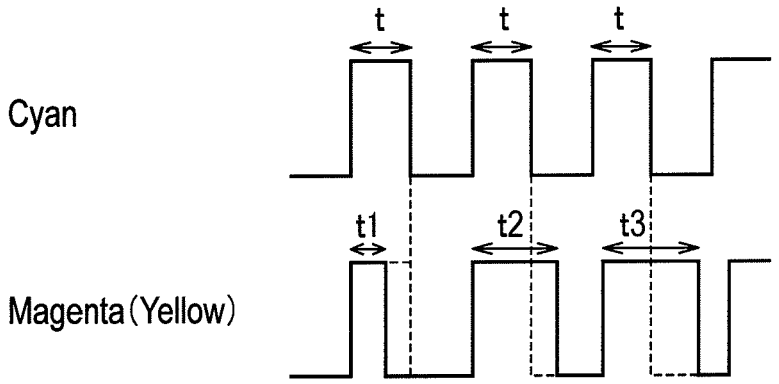
FIG. 11 is an explanatory diagram showing components included in correction profile data stored in the external storage device in FIG. 8, to correct the deviation of landing position of ink of each color caused by the transfer unevenness of the transfer belt.

In addition, the correction contents of the correction profile data include the components to correct the deviation of landing position of ink of each color caused by the transfer unevenness of the transfer belt 160, as described above. Consequently, as shown in FIG. 11, the correction contents of the correction profile data include components to correct the ejection timing of ink of magenta (M) and ink of yellow (Y) with respect to the ejection timing of ink of cyan (C) having a pulse width t, in accordance with the transfer unevenness of the transfer belt 160, such as pulse widths t1, t2, t3, . . . .

Note that the correction profile data is defined for each nozzle or for each head block 110*a* of the line head 110 of each color. Alternatively, the correction profile data is defined for each number of drops. The reason is that when the number of drops changes, the contents of the deviation of landing position change and the contents of the change in color generated change.

Furthermore, it is desirable to provide the correction profile data for each size of the print paper S. The reason is that when the size of the print paper S is different, the position of each print paper S on the transfer belt 160 on which it is transferred changes and the correction contents of the ejection timing used at the time of the ejection of ink, which is defined in accordance with the transfer distance of the transfer belt 160, changes.

Moreover, it is desirable to provide the correction profile data for each type of the print paper S. The reason is that when the type of the print paper S is different, the dot gain changes, and the contents of the deviation of landing position change as in the case where the number of drops changes, and the contents of the change in color generated change.

It is possible to store the correction profile data in the external storage device 93, for example, before shipping the inkjet printer 1, by acquiring it for each inkjet printer 1. It is possible to acquire, from the print result of the test pattern image for the actual print paper S, the contents of the correction profile data, for example, the amount of correction of the ejection timing of ink droplets ejected from each nozzle of the head block 110*a* in the same row of the line head 110 of each chromatic color excluding K (black).

It may also be possible to update the correction profile data when there is newly generated an event that causes the landing position deviation pattern of ink droplets of each chromatic color to change, such as replacement of the head block 110*a* or the image forming path CR1 with another.

The client terminal 14 includes a PC (personal computer) or the like and includes a CPU 16 configured to perform various kinds of processing on the basis of control programs stored in a ROM 17, a RAM 18 that functions as a working area of the CPU 16, an input unit 19 including a keyboard, mouse or the like, and an output unit 20 including a liquid crystal display or the like.

In addition to the above-described external interface unit 15, to the CPU 16, an external storage device 21 and a disk drive 22 are connected. In the external storage device 21, various kinds of data, programs, storage regions of data of original images and the like are ensured.

The CPU 16 starts up the application program of the external storage device 21, and for example, in the case where instructions to print data of an original image of the external storage device 21 are input, the CPU 16 generates a print job of the original image to be printed and outputs the generated print job to the external interface unit 11 of the control unit 10 from the external interface unit 15. It is possible to output the print job to the control unit 10 through the execution by the CPU 16 of a printer driver program stored in the external storage device 21.

It is also possible for the CPU 16 to read various kinds of programs and data from a disc-shaped recording medium 50 such as an optical disc, by the disk drive 22 of the client terminal 14 and to install (record) them in the external storage device 21 or to transfer them to the side of the inkjet printer 1.

Figure 12:
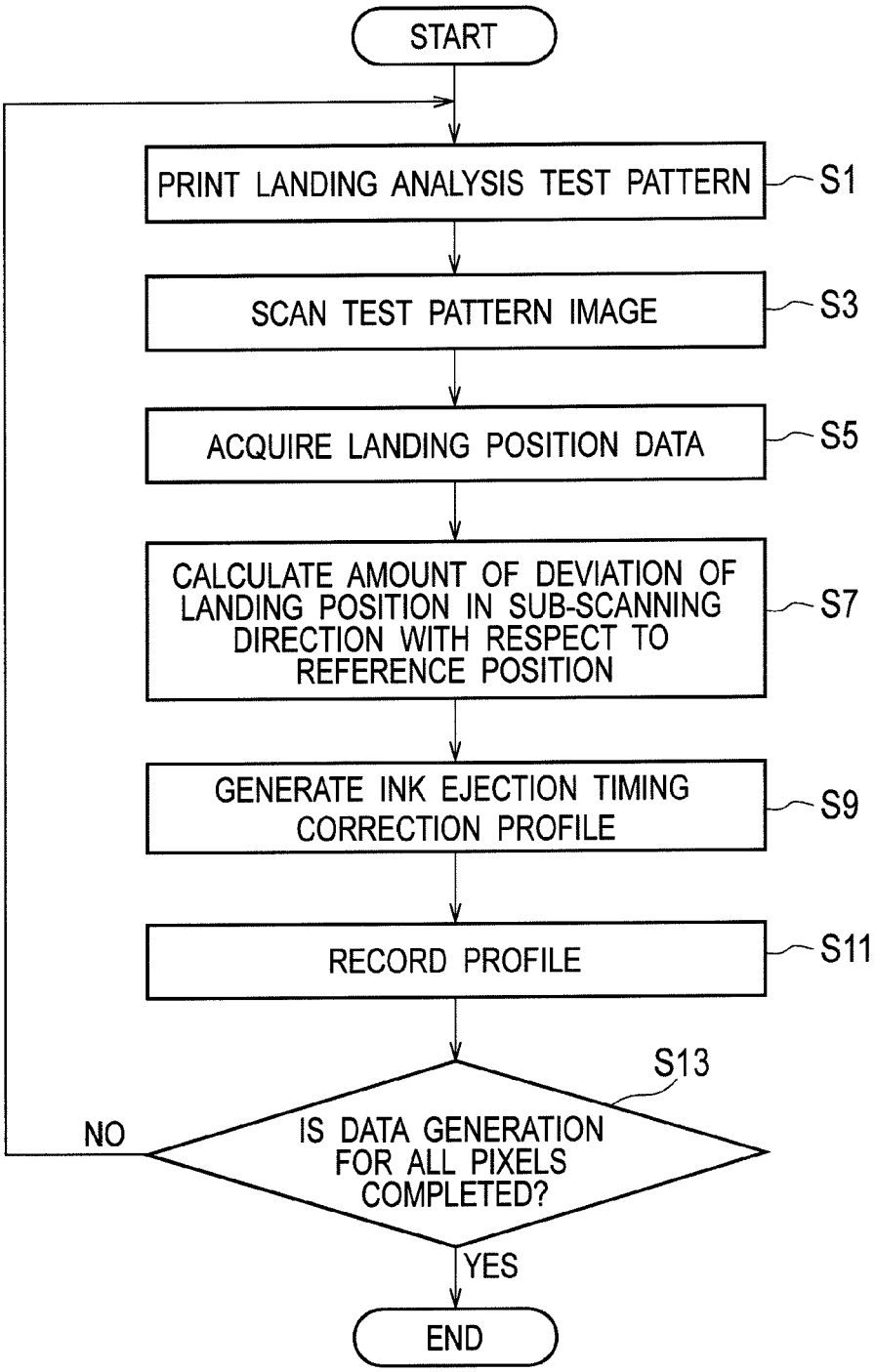
FIG. 12 is a flowchart showing a procedure when generating the correction profile data in the external storage device in FIG. 8.

Next, a profiling procedure of correction profile data in the external storage device 93, that is, a generation procedure of profile data will be explained. FIG. 12 is a flowchart showing a generation procedure of profile data.

When generating correction profile data, first, at step S1 in FIG. 12, a test pattern for detecting the deviation of landing position of each pixel is printed by the inkjet printer 1.

The test pattern is provided for each of the paper size, the paper type, and the number of drops and is a pattern in which dots are formed by ink droplets of each chromatic color of at least cyan (C), magenta (M), and yellow (Y) ejected in a specified number of drops from the nozzle corresponding to each pixel across the entire surface of the print paper S.

Here, in the case where there is already stored, in the external storage device 93 and the like, belt profile data (not shown) which specifies the correction value of the ejection timing of ink from the nozzle, for eliminating the deviation of landing position caused by the transfer unevenness of the transfer belt 160, it may also be possible to print a test pattern image by correcting the ejection timing with the correction value specified therein.

As a matter of course, it may also be possible to print the test pattern image without performing the ink ejection timing correction using the belt profile data even if it exists already. In the present embodiment shown below, it is assumed that the test pattern image is printed without performing the ink ejection timing correction using the belt profile data.

Next, at step S3 in FIG. 12, the scanner unit 101 reads the test pattern and furthermore, at step S5, the control unit 10 analyzes the image data to thereby acquire the landing position of the dot of each pixel on the test pattern image. Then, by comparing the landing position with the standard landing position for each pixel of the print paper S the control unit 10 recognizes in advance, the deviation of landing position in the sub-scanning direction Yd in each pixel is calculated (step S7).

Then, there is generated correction profile data, in which the correction values of the ink ejection timing for eliminating the deviation of ink landing position (amounts of the deviation of relative position, exceeding a predetermined range, between cyan (C) and magenta (M) and between cyan (C) and yellow (Y)) caused by the transfer unevenness of the transfer belt 160 and other factors are associated with the transfer distances of the print paper S on the transfer belt 160 (step S9) and the generated correction profile data is stored in the external storage device 93 (step S11).

Here, the correction values of the ejection timing may be set to values with which the difference between the amount d_CM of the deviation of landing position between cyan (C) and magenta (M), and the amount d_CY of the deviation of landing position between cyan (C) and yellow (Y) is included within a predetermined range.

Furthermore, the correction values of the ejection timing may be set to values corresponding to the amount of adjustment of the relative landing position of the dot by the ink ejected from the line head 110 of the color located at the downstream side, with respect to the landing position of the dot by the ink ejected from the line head 110 of the color located at the upstream side in the sub-scanning direction Yd, which is the transfer direction of the print paper S by the transfer belt 160.

Specifically, for example, it may also be possible to set the correction values of the ejection timing of ink from the nozzle of magenta (M) and yellow (Y) so that the landing positions of the dots of magenta (M) and yellow (Y) become closer to the landing position of the dot of cyan (C).

By doing so, it is made possible to easily determine the amount of correction of the ejection timing of each color by bringing the landing position of the ink droplet of the color that lands on the print paper S later closer to the landing position of the ink droplet of the color that lands on the print paper S earlier.

In any content, in the correction profile data generated at step S9 in FIG. 12, there are defined the correction contents for setting, to a certain level at all times, the amount d_CM of the deviation of landing position in the sub-scanning direction Yd of ink of magenta (M) with respect to ink of cyan (C) and the amount d_CY of the deviation of landing position in the sub-scanning direction Yd of ink of yellow (Y) with respect to ink of cyan (C), regardless of the transfer distance of the print paper S as shown in FIG. 10B. Consequently, in the present embodiment, cyan (C) corresponds to the reference color in claims.

After the generated correction profile data is stored in the external storage device 93, whether or not the correction profile data is generated for all the pixels of the test pattern image is checked (step S13) and when not generated yet (NO at step S13), the procedure returns to step S1 and when generated already (YES at step S13), the series of procedures is exited.

Figure 13:
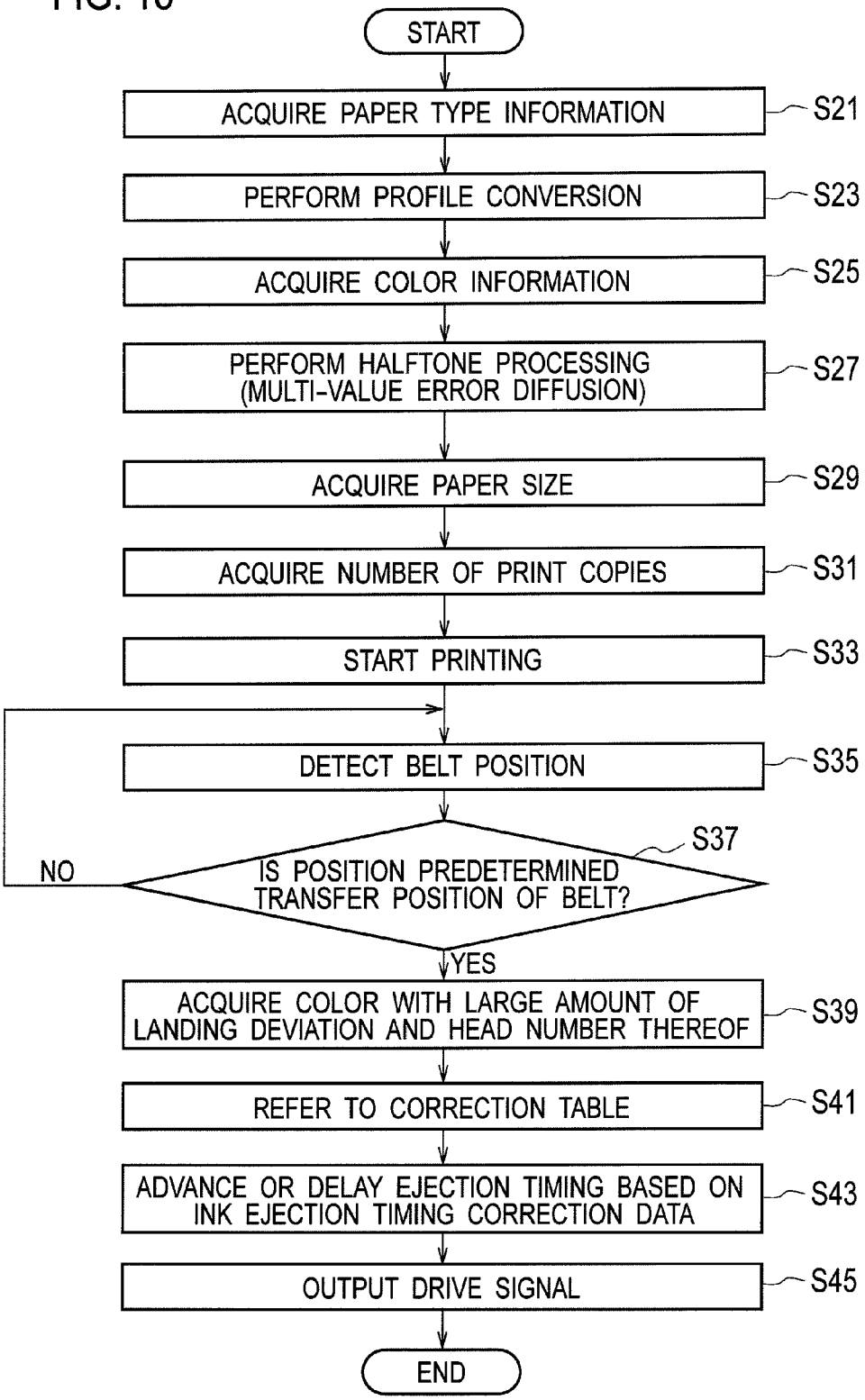
FIG. 13 is a flowchart showing a procedure when the control unit in FIG. 8 corrects the ink ejection timing by referring to the correction profile data.

Next, a procedure of ink ejection timing correction performed by the control unit 10 using the correction profile data stored in the external storage device 93 when printing an image on the print paper S by the inkjet printer 1 will be explained using the flowchart in FIG. 13.

First, the control unit 10 acquires the setting information of the type of the print paper S used for printing an image (step S21). The setting information of this type is set in the corresponding area of the RAM 92 on the basis of, for example, the printing environment information in the print job from the client terminal 14. Then, the data of the RGB color model constituting the image data to be printed is converted into the data of the CMYK color model (color profile conversion) (step S23).

Next, the control unit 10 acquires the color information of the image from the image data subjected to color profile conversion (step S25) and also acquires the drop data of the image to be printed from the image data subjected to color profile conversion by halftone processing (step S27). At this time, the number of drops less than an integer is diffused into the peripheral pixels by error diffusion processing.

Subsequently, the control unit 10 acquires the size of the print paper S used for printing an image and the number of print copies from the printing environment information of the print job (steps S29, S31) and detects the position in the rotation of the transfer belt 160 (step S35) after starting the printing operation (step S33), and checks whether or not the position in the rotation for which the correction value of the ejection timing is specified in the correction profile data (the transfer distance of the print paper S by the transfer belt 160) is reached, that is, checks whether or not the predetermined transfer position is reached (step S37).

In the case where the predetermined transfer position is not reached yet (NO at step S37), the procedure returns to step S35, and in the case where the position is reached (YES at step S37), the control unit 10 acquires the number of the head block 110*a* including the nozzle corresponding to the pixel for which the correction value of the ejection timing is specified in the correction profile data on the line (in the main-scanning direction Xd) of the pixel corresponding to the position in the rotation that is reached (step S39).

Then, the control unit 10 refers to the correction value of the correction profile data (step S41) and corrects the ejection timing with the correction value that is referred to (step S43). At this time, depending on the sign of the correction value, the ejection timing is advanced or delayed. Furthermore, after generating and outputting a drive signal to drive the nozzle with the ejection timing after the correction (step S45), the control unit 10 exits the series of procedures.

As is also obvious from the above explanation, in the present embodiment, the control unit 10 corresponds to the landing-position-deviation-pattern acquisition unit, the corrector, the size detector, and the paper type setting unit in claims.

Meanwhile, in the case where the correction profile data generated from the test pattern image printed using the belt profile data (not shown) stored in the external storage device 93 and the like is used, at step S45, the ink ejection timing corrected preliminarily with the correction value of the belt profile data may be further corrected with the correction value of the correction profile data and the drive signal may be generated. In this case, the control unit 10 corresponds to the preliminary corrector.

(Operation/Effect)

According to the present embodiment as described above, from the contents of the deviation of landing position of each pixel calculated by reading, with the scanner unit 101, the test pattern image printed by the inkjet printer 1, the correction profile data specifying the correction value of the ink ejection timing is generated.

In the correction profile data, there are defined, for each transfer distance of the print paper S, the correction contents of the ejection timing of ink of magenta (M) and ink of yellow (Y), for setting, to a certain level at all times, the amount d_CM of the deviation of landing position in the sub-scanning direction Yd of ink of magenta (M) with respect to ink of cyan (C) and the amount d_CY of the deviation of landing position in the sub-scanning direction Yd of ink of yellow (Y) with respect to ink of cyan (C), regardless of the transfer distance of the print paper S.

Then, in the test pattern image read by the scanner unit 101, the component of the deviation of ink landing position caused by the transfer unevenness of the transfer belt 160 is included, and thus, in the correction profile data generated on the basis of this, the correction component for eliminating the component of the deviation of ink landing position caused by the transfer unevenness of the transfer belt 160 is also included.

Therefore, it is possible to acquire the correction value of the ink ejection timing, which allows elimination of not only the deviation of landing position caused by the transfer unevenness of the transfer belt 160 but also the deviation of landing position caused by other factors such as a reduction in size of the ink droplet.

Consequently, by performing the ink ejection timing correction through the use of the correction profile data, it is possible to suppress the deviation of ink landing position caused by the transfer unevenness of the transfer belt 160 and also to suppress the deviation of ink landing position generated by the different causes.

Meanwhile, in each embodiment described above, it is assumed that the correction value of the deviation of landing position of the ink droplet of each color and the ejection timing corresponding thereto is determined for each head block 110*a* or for each nozzle of the line head 110 of each color. However, it may also be possible to determine the correction value of the deviation of landing position of the ink droplet of each color and the ejection timing corresponding thereto for (each line head 110 of) each color.

Consequently, as in each embodiment described above, it is possible to use the present invention also in the case where the line head 110 is constituted by a single block in addition to the case where the line head 110 is constituted by a plurality of the head blocks 110*a*.

Furthermore, in each embodiment described above, explanation has been given while taking, as an example, the inkjet printer 1 that performs full-color printing through the use of three chromatic colors of M (magenta), Y (yellow), and C (cyan) in addition to K (black). However, it is possible to widely use the present invention for an image forming device that performs color printing by the inkjet method through the use of at least two chromatic colors.

While the preferred embodiments of the present invention have been described using specified terms, such description is for illustrative purposes, and it is to be understood that changes and variations may be made without departing from the spirit or scope of the following claims.

The present application claims the benefit of priority to Japanese Patent Application No. 2012-214738, filed on Sep. 27, 2012, the entire content of which is incorporated herein by reference.

According to the present invention, it is possible to suppress the deviation of ink landing position caused by the transfer unevenness of the transfer belt and also to suppress the deviation of ink landing position caused by other factors.

DESCRIPTION OF REFERENCE NUMERALS OR SYMBOLS

1 line-type inkjet printer
10 control unit
11 external interface unit of control unit
14 client terminal
15 external interface unit of client terminal
16 CPU of client terminal
17 ROM of client terminal
18 RAM of client terminal
19 input unit
20 output unit
21 external storage device of client terminal
22 disk drive
50 disc-shaped recording medium
90 CPU of control unit
91 ROM of control unit
92 RAM of control unit
93 external storage device of control unit
101 scanner unit
102 printer unit
103 display
105 paper feeder
109 paper discharger
110 line head
110*a* head block
160 transfer belt
161 drive roller
162 driven roller
500 head holder
500*a* head holder surface
500*b* attachment opening
CR1 image forming path
S print paper
Xd main-scanning direction
Yd sub-scanning direction

What is claimed is:

1. An image forming device for forming a color image on a print paper by arranging a line head in which a plurality of nozzles is provided, and is arranged so as to extend along a main-scanning direction, for each color at intervals in a sub-scanning direction perpendicular to the main-scanning direction, and causing ink droplets from the nozzle corresponding to the line head of each color to land on the same pixel of the print paper transferred in the sub-scanning direction by a transfer belt, the image forming device comprising:

a landing-position-deviation-pattern acquisition unit configured to acquire a landing position deviation pattern of ink droplets of each color, for at least one period, from a test pattern image in a plurality of chromatic colors formed on the print paper by the ink droplets from the line head;

a storage unit configured to storing, as correction profile data which is associated with an amount of rotation of the transfer belt corresponding to the one period, a correction pattern of an ejection timing of ink of each color, for setting, to a certain level, the relative deviation of landing position of ink droplets of each color obtained from the landing position deviation pattern of ink droplets of each color for the one period, during the rotation of the transfer belt corresponding to the one period; and a corrector configured to determine the amount of ejection timing correction of ink droplets by each nozzle of the line head of each color on the basis of the correction profile data stored in the storage unit for each color and the amount of rotation of the transfer belt and configured to correct the ejection timing of ink droplets by each nozzle of the line head of each color with the determined amount of correction.

2. The image forming device according to claim 1, wherein the landing-position-deviation-pattern acquisition unit identifies the one period by performing Fourier transform on the composite fluctuation amount of each amount of the deviation of landing position of ink droplets of other colors with respect to ink droplets of a reference color in the test pattern image, and acquires the landing position deviation pattern of each ink droplet between the reference color and the other colors for the identified one period.

3. The image forming device according to claim 2, wherein the correction pattern of the correction profile data defines an adjustment amount of the relative landing position of ink droplets from the line head at the downstream side with respect to the landing position of ink droplets from the line head at the upstream side in the transfer direction of the print paper by the transfer belt.

4. The image forming device according to claim 1, wherein the correction pattern of the correction profile data defines an adjustment amount of the relative landing position of ink droplets from the line head at the downstream side with respect to the landing position of ink droplets from the line head at the upstream side in the transfer direction of the print paper by the transfer belt.

* * * * *